United States Patent [19]

Reist

[11] Patent Number: 4,718,656

[45] Date of Patent: Jan. 12, 1988

[54] METHOD OF, AND APPARATUS FOR, LOADING A SINGLING INSTALLATION FOR PRINTED PRODUCTS, ESPECIALLY A FEEDER

[75] Inventor: Walter Reist, Hinwil, Switzerland

[73] Assignee: Ferag AG, Hinwil, Switzerland

[21] Appl. No.: 856,027

[22] Filed: Apr. 25, 1986

[30] Foreign Application Priority Data

May 2, 1985 [CH] Switzerland ..... 01859/85

[51] Int. Cl.[4] ..... B65H 5/22

[52] U.S. Cl. ..... 271/3.1; 271/202; 271/69

[58] Field of Search ..... 271/3.1, 7, 69, 202, 271/3, 206, 204, 184, 185, 198, 306; 198/459, 125

[56] References Cited

U.S. PATENT DOCUMENTS

| | | | |
|---|---|---|---|
| 1,752,681 | 4/1930 | Maxson | 122/117 |
| 3,236,162 | 2/1986 | Reist . | |
| 3,945,633 | 3/1976 | Knopp | 271/3.1 |
| 3,945,635 | 3/1976 | Maria | 271/202 |
| 4,046,369 | 9/1977 | Kluge et al. | 271/3.1 |
| 4,133,523 | 1/1979 | Berthelot | 271/202 |
| 4,214,744 | 7/1980 | Evans | 271/202 |
| 4,443,287 | 4/1984 | Worni | 271/202 |

FOREIGN PATENT DOCUMENTS

| | | |
|---|---|---|
| 3329627 | 4/1984 | Fed. Rep. of Germany . |
| 1042884 | 9/1966 | United Kingdom . |
| 1506113 | 4/1978 | United Kingdom . |
| 1578250 | 11/1980 | United Kingdom . |

*Primary Examiner*—Joseph J. Rolla
*Assistant Examiner*—Kenneth Noland
*Attorney, Agent, or Firm*—Werner W. Kleeman

[57] ABSTRACT

The printed products are supplied in an imbricated formation by an infeed device and are pushed together to form a reclining buffer stack concomitant with a reduction in their mutual spacing or imbrication pitch. This buffer stack is conveyed to a stack accommodating space of a feeder by a conveying device and at a reduced conveying speed as compared to the infeed rate of the infeed device. There is thus formed a stack of interaligned printed products. The printed products are individually removed from the stack at a product withdrawal location which is determined by a stop. The buffer stack forms a printed product storage device for bridging interruptions in the supply or infeed of the printed products.

32 Claims, 8 Drawing Figures

16a
16
48
3a
A
49
S
3
63
64
31
61
36
49a
B
61
54
D
56
36
3
55
S'
47
14
51
56'
46
24
C
24a
53
52

METHOD OF, AND APPARATUS FOR, LOADING A SINGLING INSTALLATION FOR PRINTED PRODUCTS, ESPECIALLY A FEEDER

CROSS REFERENCE TO RELATED APPLICATIONS

The present application is related to the commonly assigned, copending U.S. patent application Ser. No. 06/624,365, filed June 25, 1984, and entitled "Method of, and Apparatus for, Producing Stacks of Flexible Flat Products, Especially Printed Products," now U.S. Pat. No. 4,657,237, granted Apr. 14, 1987, as well as to the commonly assigned, copending U.S. patent application Ser. No., 06/804,519, filed Nov. 21, 1985, and entitled "Apparatus for Loading a Processing Means for Processing Flexible Flat Products, especially Printed Products", the disclosures of both of which are incorporated herein by reference.

BACKGROUND OF THE INVENTION

The present invention broadly relates to a new and improved method of, and apparatus for, loading a singling or separating or feeder installation for printed products, especially a feeder.

In its more particular aspects the present invention specifically relates to a new and improved method of loading a singling or separating installation for printed products, especially a feeder, with printed products infed in an imbricated formation to a buffer stack forming location. A stack of such printed products is formed on the rear side of a product withdrawal location. In this stack the printed products are arranged with substantially aligned side edges and the printed products are individually removed from this product withdrawal location.

In a loading apparatus for a feeder as described, for example, in German Patent Publication No. 3,425,397 corresponding to the aforementioned U.S. application Ser. No. 624,365 now U.S. Pat. No. 4,657,237, and the cognate British Patent Publication No. 2,143,216, a stack is formed behind the product withdrawal location. At this product withdrawal location the printed products are individually removed. The printed products are infed in an imbricated formation and are pushed onto the stack at its rear end. Within this stack the printed products lie flat against each other and are aligned with each other on their side edges, a configuration which is necessary for a faultless removal. The location at which the printed products are pushed onto the stack thus migrates as a joint function of the infeed rate of the printed products and the removal speed of the printed products from the stack in the longitudinal direction of the latter.

Apart from the considerably complex apparatus required for pushing the printed products onto the stack, difficulties are encountered in the known construction when the stack requires a high storage capacity, that is a great length. When the stack has a great length, the printed products can no longer be held in their mutually aligned positions along their forward movement path and this is disadvantageous for the removal operation of the individual printed products Furthermore, as known, for example, from German Patent Publication No. 2,825,420 and the cognate U.S. Pat. No. 4,240,539, granted Dec. 23, 1980, folding box blanks that arrive in an imbricated position can be banked at a back-up station to form a buffer stack in which the articles assume an inclined position. This buffer stack is formed when a subsequent processing installation is shut down and the blanks continue to be delivered. As soon as the processing installation is again set into operation, the blanks are removed from the buffer stack and transported in an imbricated formation to the processing installation.

As described, for example, in German Patent Publication No. 2,307,728, in the equipment disclosed therein for manufacturing bags or sacks the bags or sacks arrive in succession and are deposited in imbricated formation onto a conveyor belt. From this conveyor belt the bags or sacks are taken over individually and in a mutually spaced relationship by a removal conveyor.

SUMMARY OF THE INVENTION

Therefore, with the foregoing in mind, it is a primary object of the present invention to provide a new and improved method of, and apparatus for, loading a singling or separating installation for printed products, especially a feeder, and which do not exhibit the aforementioned drawbacks and shortcomings of the prior art constructions.

It is a further important object of the present invention to provide a new and improved method of, and apparatus for, loading a singling or separation installation for printed products, especially a feeder, and which permit unhindered removal of the printed products from the stack as well as forming a storage or buffer stack which is large enough to bridge an interruption in the infeed of the printed products without the necessity of a shutdown of the separating installation.

Now in order to implement these and still further objects of the invention, which will become more readily apparent as the description proceeds, the method of the present invention is manifested by the steps that, prior to adding the printed products to the stack, such printed products are pushed or banked onto a reclining buffer stack at a buffer stack forming location, whereby the mutual spacing between individual ones of the printed products is reduced The buffer stack precedes the stack which is maintained substantially constant in size. The printed products are arranged in said buffer stack at an inclination relative to their direction of displacement. The length of the buffer stack varies as a function of both the infeed rate of the printed products as well as the withdrawal rate of the printed products from the stack.

As alluded to above, the present invention is not only concerned with the aforementioned method aspects, but also relates to a new and improved apparatus of the type containing infeed means for infeeding printed products in an imbricated formation to a buffer stack forming location, accommodating means or space for accommodating a stack of printed products substantially interaligned on their side edges, and a withdrawal location for withdrawing individual printed products from the stack and bounding the accommodating means or space which accommodate the stack.

In its more particular aspects, the inventive loading apparatus comprises buffer stack forming means arranged between the infeed means and the stack accommodating means or space for forming a reclining buffer stack of adjustable length. The printed products in such buffer stack assume an inclined position relative to their direction of displacement and have a reduced mutual spacing or imbrication pitch relative to the infed imbricated formation.

The buffer stack forming means or buffer storage device is formed preceding the stack or main stack from which the printed products are individually removed or singled. This buffer storage device forms the buffer stack by condensing the arriving imbricated formation. The stack or main stack is then supplied from this buffer storage device and this stack may assume an essentially constant, comparatively short length so that the mutual contacting of the printed products in the stack does not present any difficulties and faultless individual removal of single printed products from the stack is possible. The buffer stack which is separate from the stack may assume any length without impairment of the removal process or operation.

In order to also ensure in the case of a reclining stack that the buffer stack exert as far as possible no pressure upon the stack, it is advantageous for the end section of a conveying device conveying the infed printed products to such stack to contain an ascending end section which ascends toward a support for the reclining stack.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
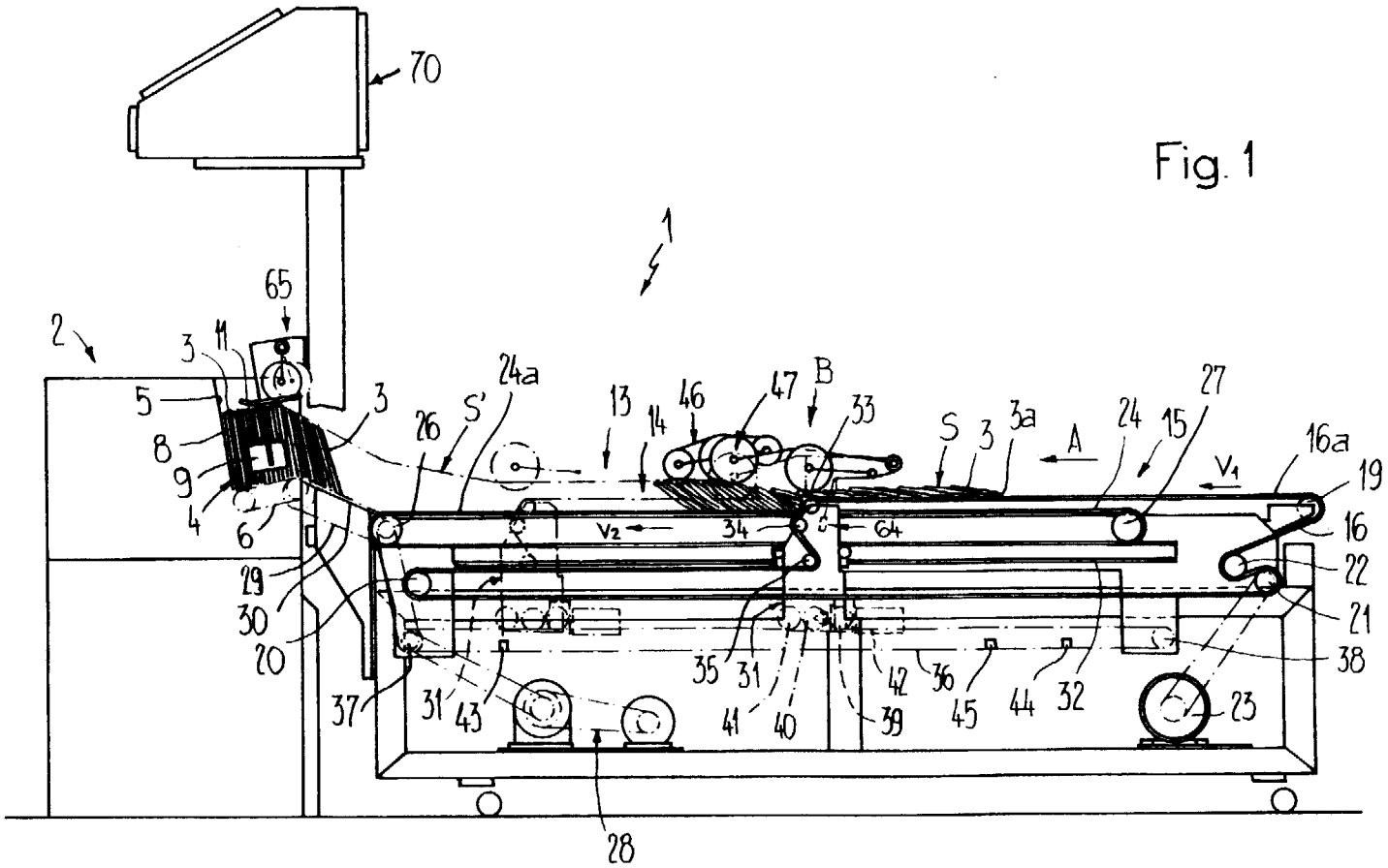
FIGS. 1 and 2 are, respectively, a side view and a top plan view of a first exemplary embodiment of the inventive loading apparatus for a feeder.
Figure 2:
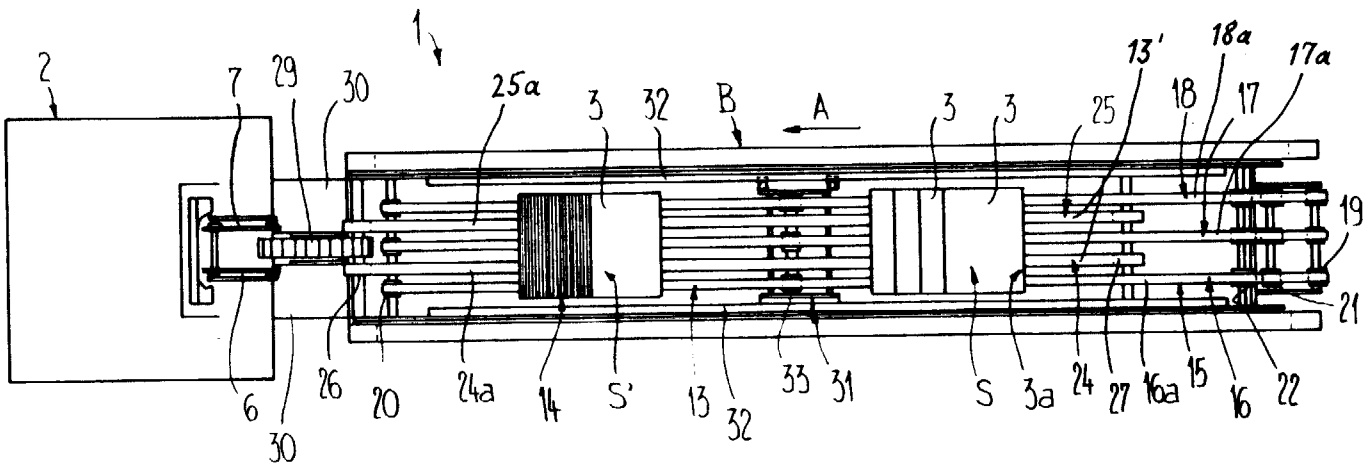

Describing now the drawings, it is to be understood that to simplify the showing thereof, only enough of the structure of the apparatus for loading a singling or separating installation has been illustrated therein as is needed to enable one skilled in the art to readily understand the underlying principles and concepts of the present invention. Turning now specifically to FIGS. 1 and 2 of the drawings, the apparatus illustrated therein by way of example and not limitation will be seen to comprise a loading apparatus 1 for a product singling installation such as a feeder 2 and which apparatus is shown in a side view and a top plan view of a first exemplary embodiment thereof.

The feeder 2 is of known construction and can, for instance, be constructed as described in Swiss Pat. No. 584,642, and therefore need not be described in more detail here, particularly since details thereof do not constitute subject matter of the present invention. The feeder 2 forms a component of a stapler or a collating machine In this feeder 2 printed products 3 are removed or withdrawn from a stack or main stack 4 in a manner which is known as such. The printed products 3 are arranged in the stack 4 such that their side edges are aligned to each other. This stack 4 is located in a stack accommodating means or space 5. The stack accommodating means or space 5 is defined or bounded at the floor or bottom thereof by two forwarding or conveying chains 6 and 7 and at the front by a stop 8 which defines a withdrawal location The stack accommodating means or space 5 is defined or bounded laterally by guide plates 9 and 10 and at the top by a stop plate 11. This is particularly evident from FIGS. 3 and 4. The upper stop plate 11 may be vibrated by means of a vibrator 12.

Figure 5:
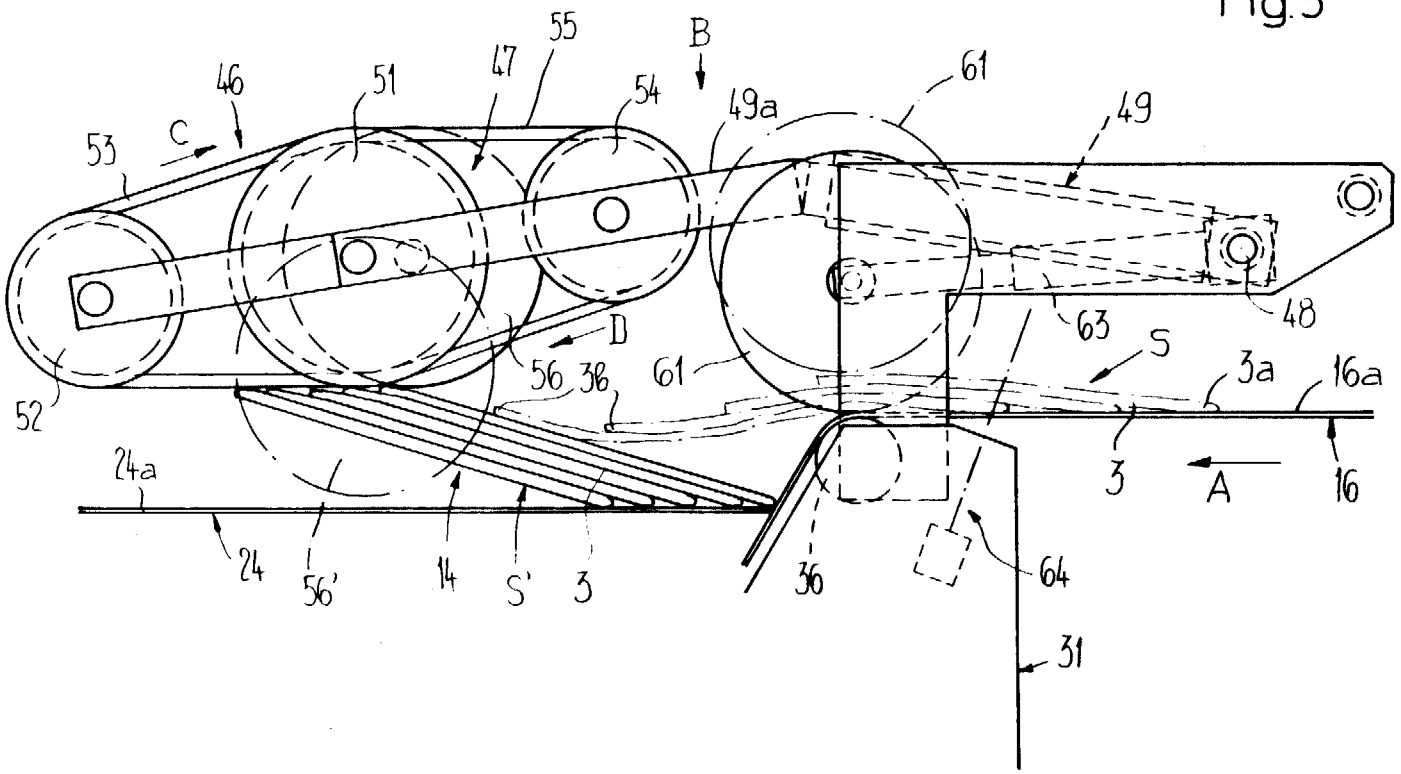
FIGS. 5 and 6 are, respectively, a side view and a top plan view, at an enlarged scale with respect to FIGS. 1 and 2, and show a region in which the incoming printed products are pushed onto a buffer stack.

Buffer stack forming means or a buffer storage device 13, defining a buffer stack forming location, are arranged to precede the stack accommodating means or space 5, as can be seen in FIGS. 1 and 2. The buffer stack forming means 13 contain conveying means 13 for supporting and feeding the infed printed products 3 which have been pushed or slid upon each other, i.e. banked, in order to thereby form a buffer stack 14 which adjoins the stack 4 on the side remote from the stop or withdrawal location. The printed products 3 are infed in an imbricated formation S through product infeed or supply means 15. In the arriving imbricated formation S every printed product 3 bears upon or partially overlies a preceding printed product 3 as seen in the general conveying direction indicated by the arrow A. Thus, a trailing edge 3*a* of the printed products 3, which in the present case constitutes a folded edge, is located on the underside of the imbricated formation S, as can be seen in FIGS. 1 and 5. The infeed means 15 are preceded by a here not particularly shown wound printed product package of the type as described in German Pat. No. 3,123,888 and the cognate U.S. Pat. No. 4,438,618. The printed products 3 may be unwound from this printed product package and fed in the imbricated formation S via the infeed means 15 to the conveying means 13'.

As can be seen from FIGS. 1 and 2, the infeed means 15 are formed by three endless conveyor belts 16, 17 and 18 arranged in a mutually spaced relationship and guided by stationary deflection rolls 19, 20, 21 and 22. The deflection roll 21 is driven by a suitable drive means 23 such that the conveyor belts 16, 17 and 18 are circulatingly driven in the general conveying direction A at a speed $v_1$ which constitutes the infeed rate at which the printed products 3 are infed into the inventive loading apparatus.

The conveying means 13' possess two endless conveyor belts 24 and 25 which are arranged in a mutually spaced relationship and which are guided at two stationary deflection rolls 26 and 27. As can be seen in FIG. 2, the conveyor belts 24 and 25 respectively extend intermediate the conveyor belts 16 and 17 and intermediate the conveyor belts 17 and 18 of the infeed means 15. The deflection roll 26 is driven by a suitable drive means 28 such that the conveyor belts 24 and 25 also circulate in the general conveying direction A at a conveying speed $v_2$ which, however, is lower than the circulating speed or infeed rate $v_1$ of the conveyor belts 16, 17 and 18 of the infeed means 15. The infeed means 15 thus define a predetermined infeed direction and the conveying means 13' thus define a predetermined conveying direction and both the predetermined infeed direction and the predetermined conveying direction extend in the general conveying direction A. As seen in the general conveying direction A, the belts 24 and 25 are followed by an ascending end section or conveying element 29 which constitutes a toothed or serrated belt possessing an effective conveying section which ascends towards the stack accommodating space or means 5. Support plates 30 are arranged laterally of the ascending end section or conveying element 29 and such support plates 30 also ascend from the conveyor belts 24 and 25 towards the stack accommodating space or means 5.

In a transition region B of the transition from the infeed means 15 to the conveying means 13', a slide means or carriage 31 of the buffer stack forming means 13 is arranged and supported at guide rails 32. The slide means or carriage 31 extends in the general conveying direction A and is reciprocatingly displaceable in such conveying direction A. Deflection rolls 33, 34 and 35 are arranged on this slide means or carriage 31, see FIG. 1, in mutually superposed and laterally offset relationship. Upper runs 16*a*, 17*a* and 18*a* of the related conveyor belts 16, 17 and 18 are downwardly guided at the deflection rolls 33, 34 and 35. As illustrated in FIG. 1 with respect to the conveyor belts 16 and 24, the effective conveying runs 16*a*, 17*a* and 18*a* of the related conveyor belts 16, 17 and 18 extend, as seen in the general conveying direction A, precedingly of the slide means or carriage 31 above upper runs 24*a* and 25*a* of the related conveyor belts 24 and 25. Thus, the upper runs 16*a*, 17*a* and 18*a* of the related conveyor belts 16, 17 and 18 are downwardly guided at the slide means 31 so that, as seen in the general conveying direction A, the now upper and now effective conveying runs 24*a* and 25*a* of the related conveyor belts 24 and. 25 extend above the upper runs 16*a*, 17*a* and 18*a* of the related conveyor belts 16, 17 and 18 on the rear side of the slide means or carriage 31.

The slide means or carriage 31 is coupled to a drive element constituting a drive chain 36 which is guided at two stationary chain or sprocket wheels 37 and 38. In this arrangement the chain or sprocket wheel 37 is circulatingly driven by the drive 28 at the speed $v_2$, i.e. the conveying speed of the conveying device 13' and in the general conveying direction A. An upper run of the drive element or chain 36 is guided at three chain or sprocket wheels 39, 40 and 41 which are mounted on the slide means or carriage 31. The central chain or sprocket wheel 40 is connected with drive means 42 containing a motor and which drive means 42 are secured to the slide means or carriage 31 and drive such chain or sprocket wheel 40 in counterclockwise direction. When this chain or sprocket wheel 40 is driven, it rolls along the upper run of the drive element or chain 36 and the driving speed is selected such that the slide means or carriage 31 moves in a reverse direction counter to the general conveying direction A. In FIG. 1 three position transmitters 43, 44 and 45 are schematically shown. The position transmitter 43 determines the forward end position and the position transmitter 44 determines the rearward end position of the slide means or carriage 31. The function of the position transmitter 45 will be further described hereinbelow.

Figure 6:
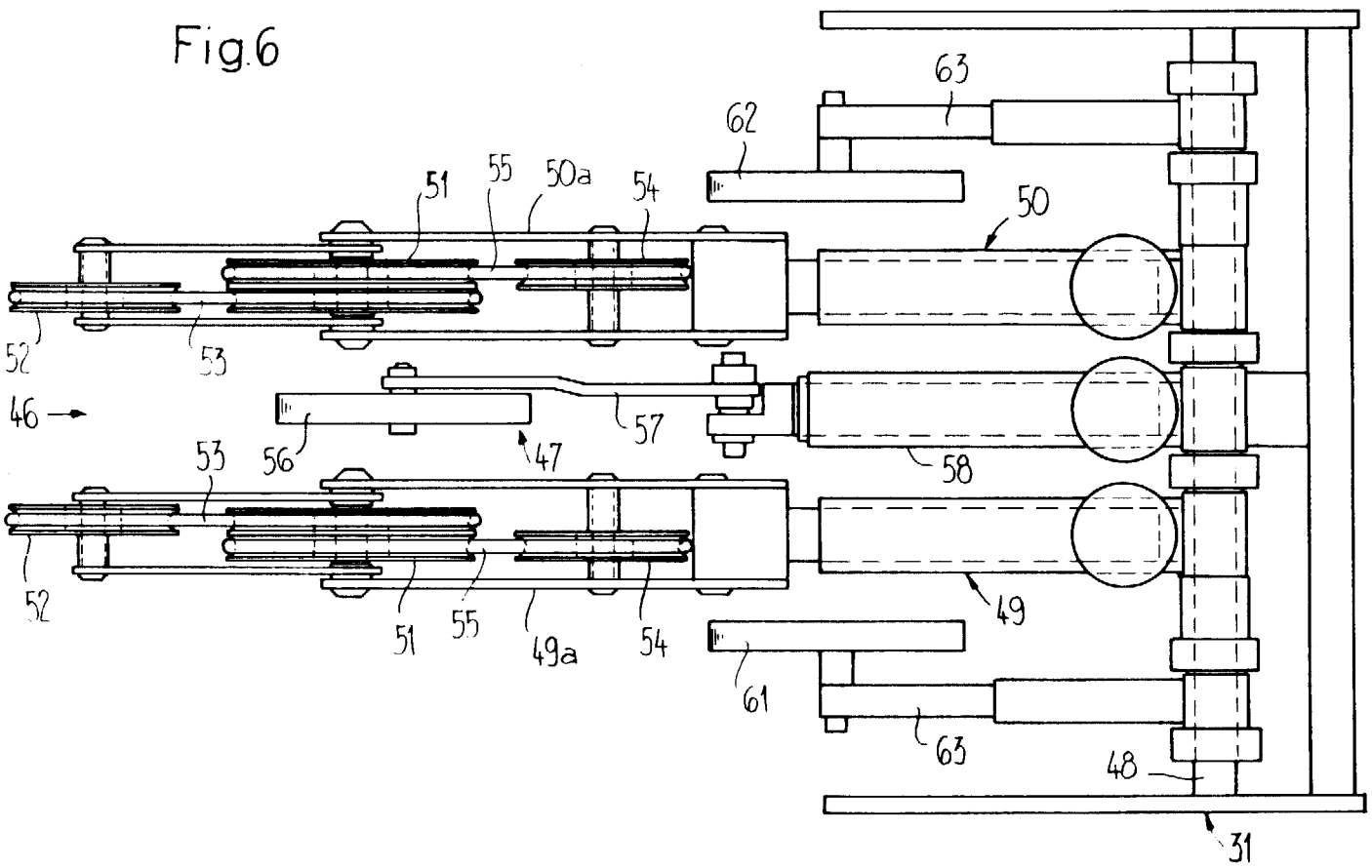
Figure 7:
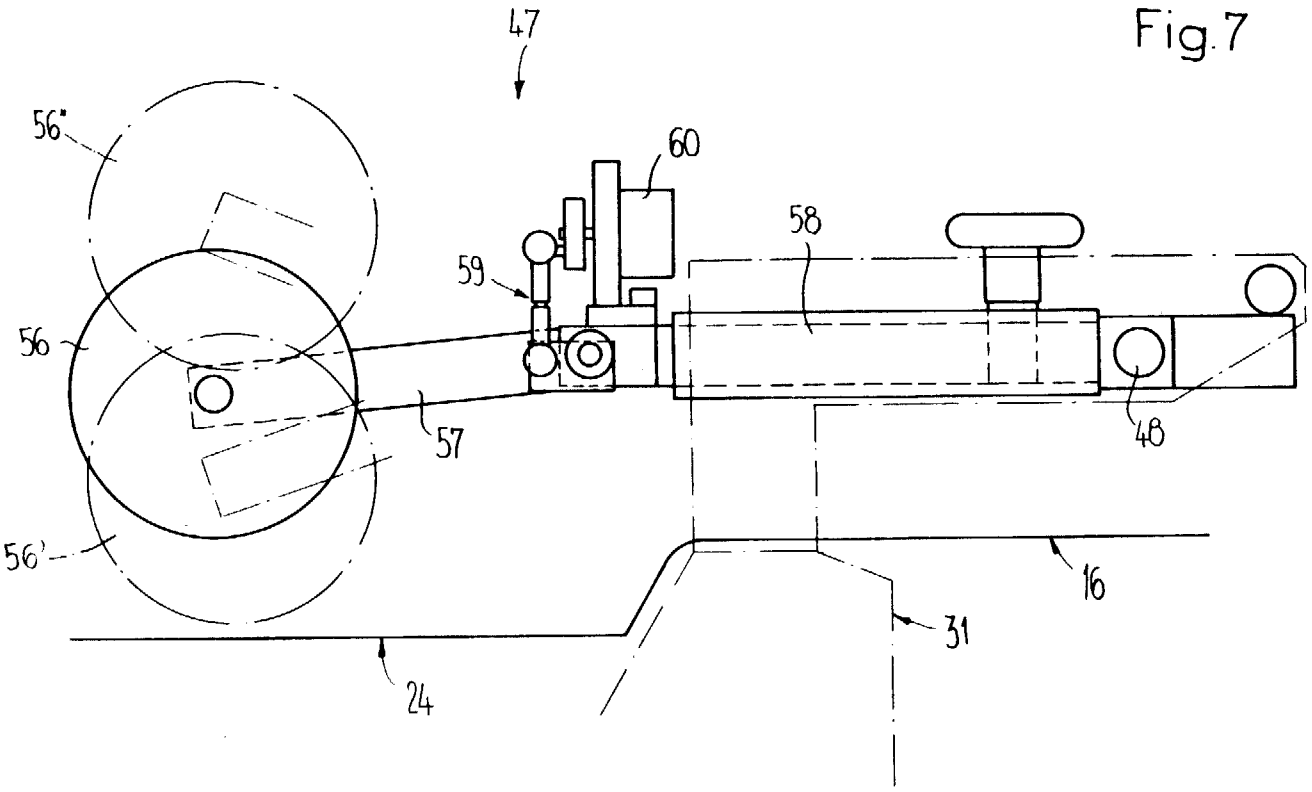
FIG. 7 shows, at the same enlarged scale as FIGS. 5 and 6, a sensing device arranged in the region shown in FIGS. 5 and 6.

Stop means 46 and a sensing device 47, whose construction will now be described in connection with FIGS. 5 to 7, are arranged above the conveyor belts 24 and 25 on the slide means or carriage 31.

In the slide means or carriage 31 there is arranged a shaft 48. Two pivotable levers 49 and 50 are mounted on the shaft 48 in a spaced relationship to each other. Stop and brake rolls 51 are associated with the stop means 46 and are rotatably mounted in related bifurcated ends 49*a* and 50*a* of the related levers 49 and 50. As seen in the general conveying direction A, associated drive rolls 52 follow the stop and brake rolls 51. The drive rolls 52, in turn, are also rotatably mounted in the related bifurcated ends 49*a* and 50*a* of the related first levers 49 and 50. Each drive roll 52 is drivingly connected via a drive belt 53 with the associated stop and brake rolls 51. Opposite the drive rolls 52 with respect to the related stop and brake rolls 51 there are rotatably mounted in the related bifurcated ends 49*a* and 50*a* related further rolls or deflection rolls 54. Each further roll or deflection roll 54 is connected with the associated stop and brake roll 51 by means of a stop element or belt 55.

As can be seen from FIGS. 1 and 5, the stop and brake rolls 51 are situated at the end of the buffer stack 14 and are supported thereon. This is also true for the drive rolls 52 and the related drive belts 53. As a result of this engagement of the drive rolls 52 and the drive belts 53 with the buffer stack 14, which moves forward at the conveying speed $v_2$, the drive belts 53 are circulatingly or revolvingly driven in the direction of the arrow C, as can be seen in FIG. 5. Consequently, the stop and brake rolls 51 are set into rotation which has the result that the stop elements or belts 55 circulate in the direction of the arrow D.

A sensing roller 56 associated with the sensing device 47 is arranged between the levers 49 and 50. As can be seen from FIGS. 6 and 7, the sensing roller 56 is mounted at one end of a pivotable lever 57. This pivotable lever 57 is articulatedly connected with a bracket 58 which is seated on the shaft 48. In accordance with FIG. 7, the pivotable lever 57 is connected with a measured-angle or angle measuring transmitter or transducer 60 by means of a coupling linkage 59. The measured-angle transmitter 60 is connected with control means for the motor of the drive means 42 and generates signals indicative of the pivot position of the pivotable lever 57. The sensing roller 56 also bears upon the rear end of the buffer stack 14.

Two load rolls 61 and 62 are respectively arranged laterally of the levers 49 and 50, and are fastened to related levers 63 which are pivotably mounted on the shaft 48. These load rolls 61 and 62 bear upon the printed products 3, which are infed in the imbricated formation S to the infeed means 15.

Furthermore, there is arranged in the slide means or carriage 31 an only schematically shown product recognition or detector device 64 which, for example, may constitute a photo-detector or gate. This product recognition or detector device 64 serves for determining a break or interruption in the infeed of printed products 3 by the infeed means 15.

Figure 3:
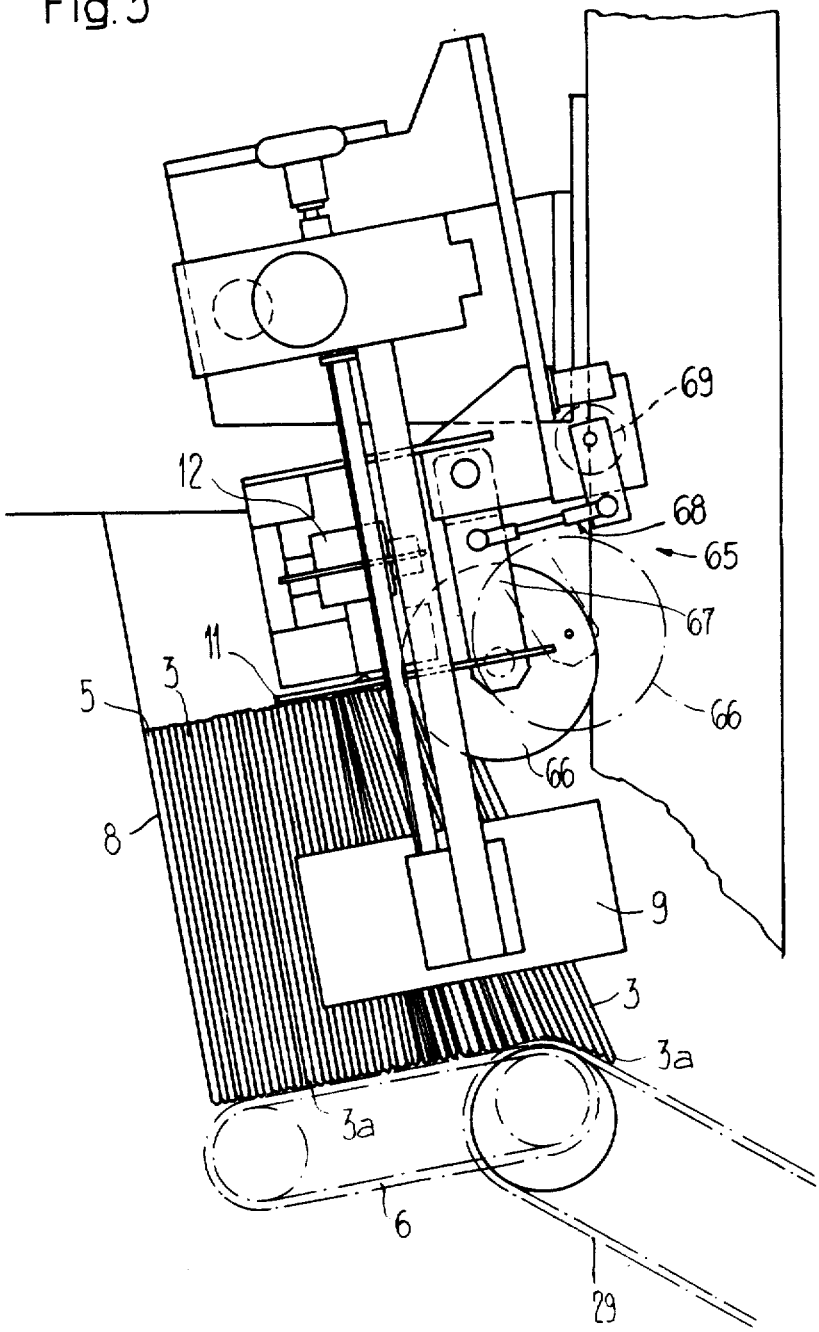
FIGS. 3 and 4 are, respectively, a side view and top plan view, at an enlarged scale with respect to FIGS. 1 and 2, and show a region of the stack accommodating means or space of the apparatus illustrated in FIGS. 1 and 2.
Figure 4:
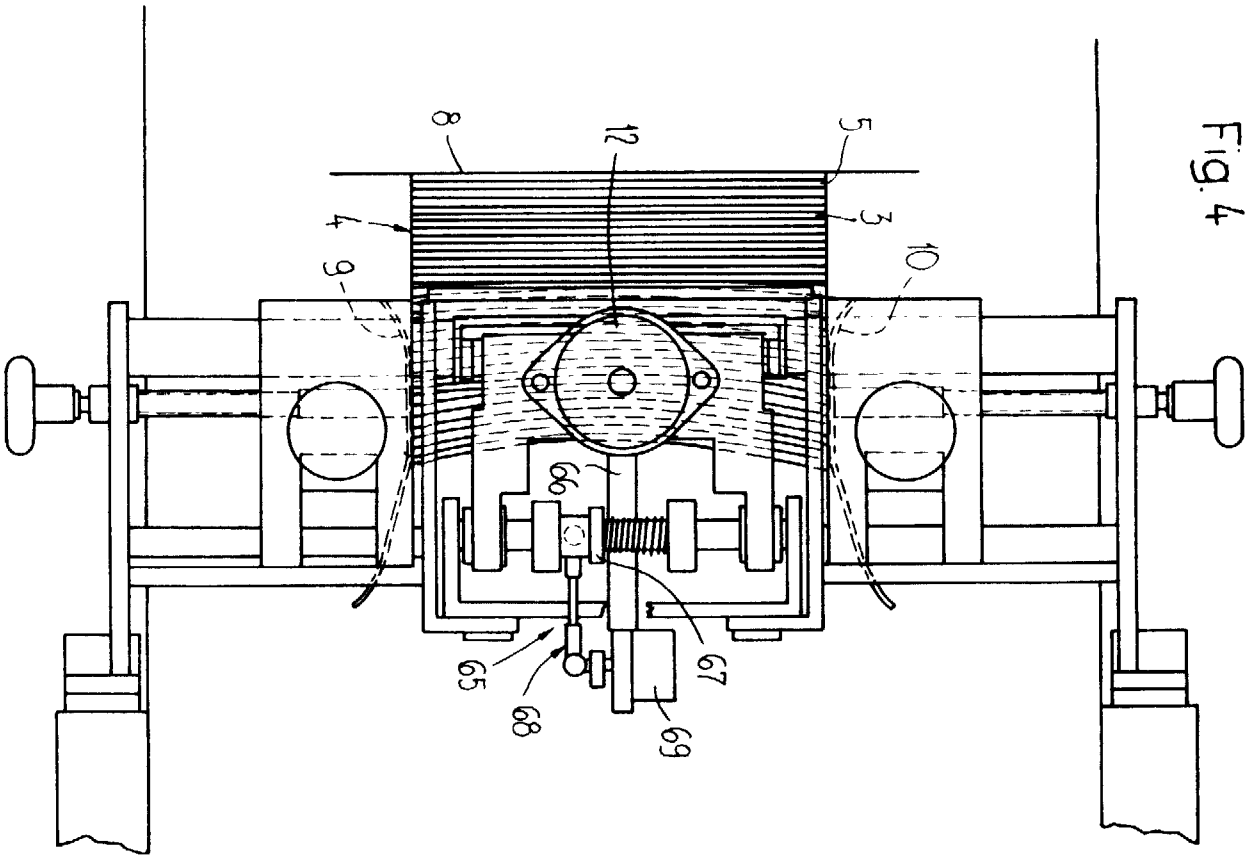

As evident from FIGS. 1, 3 and 4, a further sensing device 65 is also provided at the rear region of the stack 4 of printed products 3 and contains a sensing roll 66 fastened at one end of a pivot arm 67. This pivotably mounted. pivot arm 67 is connected by means of a coupling linkage 68, as can be seen in FIGS. 3 and 4, with a measured-angle or angle measuring transmitter or transducer 69 corresponding to the measured-angle transmitter 60 of the sensing device 47. The sensing roll 66 is supported at the rear end of the stack 4 of printed products 3. The measured-angle transmitter 69 is connected with the drive 28 and generates signals indicative of the deflection of the pivot arm 67.

In FIG. 1 a control panel is designated by reference character 70 and appropriate operating and control elements are arranged thereat.

The mode of operation of the loading apparatus 1 is as follows:

The printed products 3, which are infed in the imbricated formation S by the infeed means 15, pass through under the load rolls 61 and 62 and are pushed onto the rear of the buffer stack 14. The buffer stack 14 is displaced by the conveyor belts 24 and 25 at a conveying speed $v_2$ which is lower than the infeed speed or rate $v_1$ of the infeed means 15. During transition from the infeed means 15 to the conveying means 13', the printed products 3 are pushed together or condensed with a reduction in their mutually spaced relationship, i.e. are banked, which means that the incoming imbricated formation S is condensed. The condensed imbricated formation is designated in the Figures by the reference character S'. As distinctly illustrated in FIG. 5, the printed products 3 which are infed by the infeed means 15 at the higher infeed speed or rate $v_1$, abut with their leading edges **3*b* against the stop and brake rolls 51 and possibly also against the stop elements or belts 55. Due to the stop and brake rolls 51 and the circulatingly or revolvingly driven stop elements or belts 55, faultless pushing or banking of the printed products 3 onto the buffer stack 14 is ensured and individual printed products 3 are prevented from protruding beyond the buffer stack 14** on the top side.

When printed products 3 are infed by the infeed means 15, the buffer stack 14 grows in a rearward direction. The sensing roll 56 bears upon the buffer stack 14 and assumes its upper end position as indicated in FIG. 7 by reference character 56'', As long as the sensing roll 56 assumes this upper end position 56'', the motor of the drive means 42 for the chain or sprocket wheel 40 is switched on and the slide means or carriage 31 is moved towards the rear and counter to the general conveying direction A at the growth rate of the buffer stack 14. The infeed means 15 are stopped as soon as the slide means or carriage 31 has reached its rear end position determined by the position transmitter 44. This has the result that the sensing device or roll 47 is lowered and therewith the pivotable lever 57 is pivoted downwards. There is thus caused a shutdown of the drive means 42 by means of the measured-angle transmitter 60. This means that the slide means or carriage 31 is now entrained by the drive element or chain 36 which circulates at the conveying speed $v_2$ and thus migrates; conjointly with the buffer stack 14 in the general conveying direction A. The infeed means 15 are reactivated as soon as the slide means or carriage 31 reaches the intermediate position determined by the position transmitter 45. As soon as further printed products 3 are again pushed up or banked onto the rear of the buffer stack 14, the drive means 42 are switched on again and, as already described, the slide means or carriage 31 is again rearwardly displaced until the position transmitter 44 is activated anew. Thus, during normal operation the slide means or carriage 31 moves within the operating range predetermined by the position transmitters 44 and 45.

When the infeed of printed products 3 is interrupted, for instance, because the aforementioned printed product package acting as a supply source is empty and has to be replaced by a full printed product package, then this condition is detected by the product recognition or detector device 64. This product recognition or detector device 64 now causes switch-off of the drive means 42 which results in the slide means or carriage 31, as already mentioned, being entrained conjointly with the buffer stack 14 by the drive element or chain 36 and displaced in the general conveying direction A. As soon as printed products 3 are again infed by the infeed means 15, the drive means 42 are reactivated in the above described manner and the slide means or carriage 31 is rearwardly displaced.

If the interruption in the infeed of the printed products 3 lasts so long that the slide means or carriage 31 reaches its forward end position determined by the position transmitter 43, then the conveying means or device 13 and also the feeder 2 are shut down.

During the time period that printed products 3 are, as described, pushed or banked onto the rear of the buffer stack 14, the printed products 3 in such buffer stack 14 are advanced or forwardly displaced by the conveyor belts 24 and 25 and upwardly conveyed by the ascending section or conveying element 29 towards the stack 4. From this stack 4 the printed products 3 are individually withdrawn or removed at the product withdrawal location determined by the stop 8. The size of this stack 4 remains essentially constant and is regulated by means of the further sensing device 65. If the stack 4 increases or decreases then, the sensing roll 66 and the pivot arm 67 are deflected. By means of the measured-angle transmitter 69 which detects this pivoting movement or deflection, the drive 28 for the conveyor belts 24 and 25 and the ascending section or conveying element 29 as well as the drive element or chain 36 are correspondingly affected in order to increase or decrease, as the case may be, the conveying speed $v_2$ of the conveying means or device 13'. As an overall result, the buffer stack 14 thus is formed at a variable length due to the displacements of the slide means or carriage 31 which constitutes a length adjusting means for adjusting or varying the variable length of the buffer stack as a joint function of the infeed rate and the withdrawal rate such that the size of the stack 4 at the stack accommodating means 5 remains substantially constant.

The stack 4 in which, for a faultless singling or separating operation, the printed products 3 should be aligned to each other without being pressed upon each other, may possess a relatively small size which remains essentially constant. For the purpose of bridging interruptions in the infeed of the printed products 3, the printed products 3 are stored in the buffer stack 14 which may assume any desired length without thereby unfavorably affecting the removal of the printed products 3 from the stack 4. Due to the fact that the conveying means or device 13' is constructed in its end region, i.e. the ascending section or conveying element 29 and the support plates 30, so as to ascend towards the stack accommodating means or space 5', any undesirably high pressure is prevented from being exerted upon the lying or reclining stack 4 by the buffer stack 14.

Figure 8:
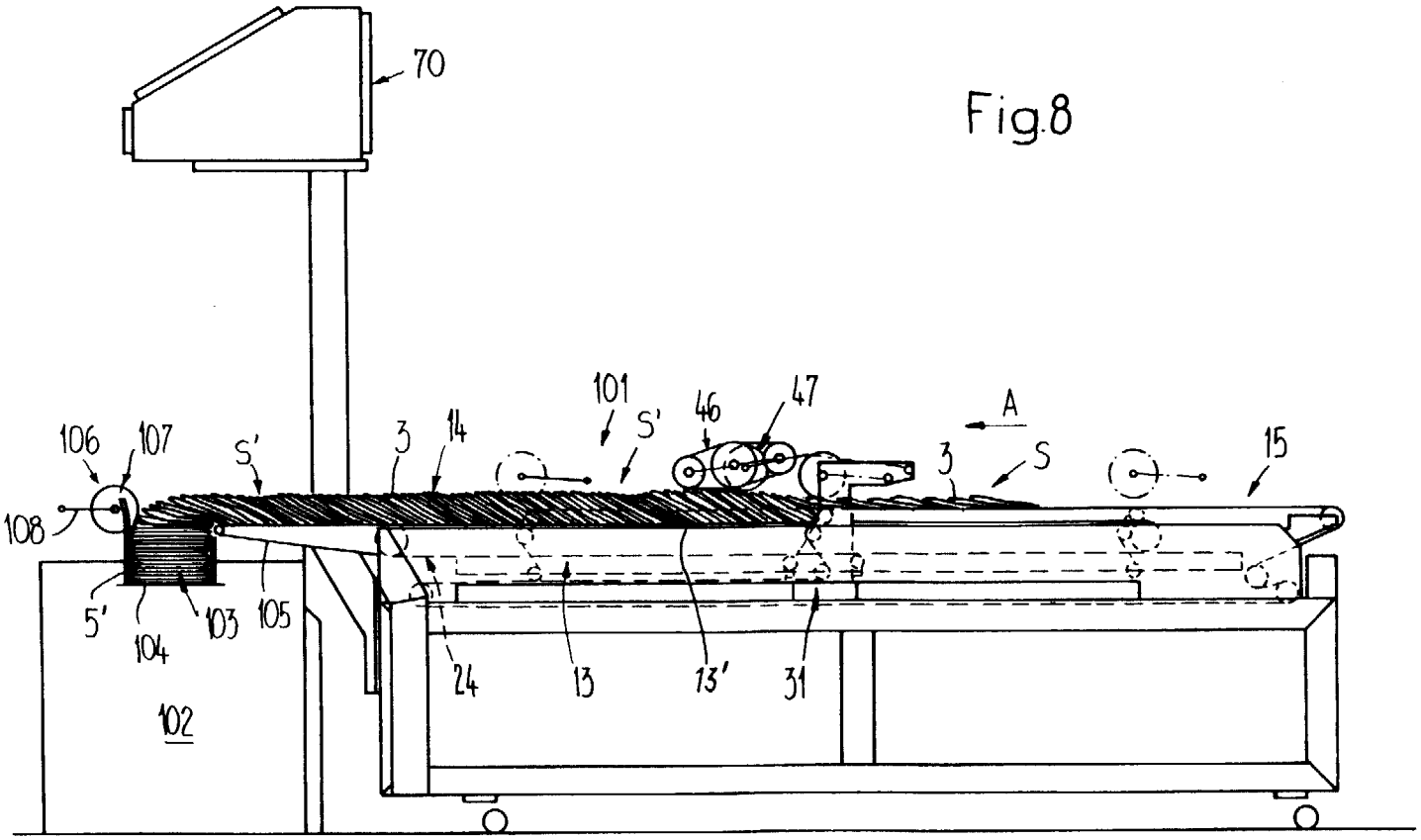
FIG. 8 is a side view corresponding to FIG. 1 and shows a second exemplary embodiment of the inventive loading apparatus for a feeder.

A second exemplary embodiment of the inventive loading apparatus is illustrated in FIG. 8 and is generally designated by the reference character 101. This second embodiment corresponds broadly to the loading apparatus 1 shown in FIGS. 1 to 7. The loading apparatus 101 depicted in FIG. 8, however, serves for loading a feeder 102 in which a stack 103 to be singled or separated is arranged in an upright or standing rather than a lying or reclining configuration as shown for the first exemplary embodiment. Thus in the embodiment according to FIG. 8, the stack accommodating means or space 5' is vertically arranged and closed at the bottom by a stop 104 defining a product withdrawal location. The conveying means or device 13' possesses, instead of the ascending section or conveyor element 29, a horizontal conveyor 105 which follows the conveyor belts 24 and 25 and which conveys the printed products 3 in the condensed imbricated formation S' to the stack accommodating means or space 5'. For sensing the height of the stack 103, there is provided a further sensing device 106 containing a sensing roller 107 which is fastened to a pivot arm 108. This further sensing device 106 corresponds to the further sensing device 65 shown in FIGS. 1, 3 and 4 with regard to construction as well as to function.

The formation of the buffer stack 14 is achieved in the second exemplary embodiment according to FIG. 8 in the same manner as described hereinbefore in connection with the first exemplary embodiment according to FIGS. 1 to 7.

While there are shown and described present preferred embodiments of the invention, it is to be distinctly understood that the invention is not limited thereto, but may be otherwise variously embodied and practiced within the scope of the following claims. Accordingly,

What I claim is:

1. A method of loading with printed products a feeder installation operatively associated with a withdrawal location, said method comprising the steps of:

infeeding the printed products in an imbricated formation at a predetermined mutual spacing between the individual printed products within said imbricated formation and at a predetermined infeed rate to a buffer stack forming location;

forming at the buffer stack forming location a buffer stack from the infed printed products such that said buffer stack precedes and adjoins a stack formed at a rear side of a withdrawal location at a feeder installation relative to a predetermined general conveying direction of the infed printed products;

said step of forming said stack entailing adding the infed printed products to said stack formed at said rear side of said withdrawal location subsequent to said step of forming said buffer stack and substantially aligning the printed products with respect to their edges and such that said stack assumes a predetermined configuration;

said step of forming said buffer stack further entailing sliding the infed printed products upon each other such that the printed products assume a reduced mutual spacing between individual ones of the infed printed products in said buffer stack and such that the printed products assume a predetermined inclination relative to said predetermined general conveying direction;

during said step of forming said stack of printed products at the rear side of the withdrawal location relative to said predetermined general conveying direction, loading the feeder installation with the printed products in said predetermined general conveying direction;

individually withdrawing the printed products from said stack at said withdrawal location of said feeder installation at a predetermined withdrawal rate;

said step of forming said buffer stack still further entailing forming a buffer stack of an adjustable length and adjusting said adjustable length of said buffer stack as a joint function of said predetermined infeed rate of the printed products and said predetermined withdrawal rate of the individual printed products such that said stack of the infed printed products at said rear side of said withdrawal location is maintained at a substantially constant size during said step of loading said feeder installation.

2. The method as defined in claim 1, further including the step of:

conveying the infed printed products in said buffer stack in said predetermined general conveying direction at a predetermined conveying speed; and selecting said predetermined conveying speed lower than said predetermined infeed rate of the printed products.

3. The method as defined in claim 1, wherein:

said predetermined configuration which said stack assumes is a reclining configuration.

4. The method as defined in claim 1, wherein:

said predetermined configuration which said stack assumes is an upright configuration.

5. A loading apparatus for loading a feeder installation, with printed products having lateral edges, said loading apparatus defining a predetermined general conveying direction in which the printed products are loaded into the feeder installation, and said loading apparatus comprising:

infeed means for infeeding the printed products arriving in an imbricated formation with a predetermined mutual spacing between individual ones of the printed products of said imbricated formation and at a predetermined infeed rate;

stack accommodating means for accommodating a stack formed from the printed products infed by said infeed means such that the printed products in said stack formed at said stack accommodating means are substantially aligned at the lateral edges thereof;

a withdrawal location for removing at a predetermined withdrawal rate said individual ones of the infed printed products from said stack accommodated by said stack accommodating means during formation of said stack;

said withdrawal location bounding said stack accommodating means;

buffer stack forming means arranged intermediate said infeed means and said stack accommodating means for forming from said infed printed products a buffer stack of the infed printed products;

said buffer stack containing the infed printed products in a predetermined configuration relative to said predetermined general conveying direction of the loading apparatus and at a mutual spacing which is less than said predetermined mutual spacing between said individual ones of the printed products in said imbricated formation;

said buffer stack adjoining said stack accommodated by said stack accommodating means on a side remote from said withdrawal location;

said buffer stack having a variable length; and said buffer stack forming means containing length adjusting means for varying said variable length of said buffer stack intermediate said infeed means and said side of said stack accommodating means, which side is remote from said withdrawal location, as a joint function of said predetermined infeed rate and said predetermined withdrawal rate such that said stack accommodated by said stack accommodating means, is maintained at a substantially constant size.

6. The apparatus as defined in claim 5, wherein:

said infeed means serve for infeeding the printed products in a predetermined infeed direction and at said predetermined infeed rate;

said buffer stack forming means containing conveying means defining a predetermined conveying direction corresponding to said predetermined general conveying direction of the loading apparatus and further defining a predetermined conveying speed;

said predetermined conveying direction defined by said conveying means having essentially the same direction as said predetermined infeed direction in which the printed products are infed by said infeed means; and said predetermined conveying speed of said conveying means being lower than said infeed rate at which the printed products are infed by said infeed means.

7. The apparatus as defined in claim 6, wherein:

said infeed means define an effective infeed path;

said conveying means defining an effective conveying path;

a transition region defining a transition from said effective infeed path defined by said infeed means to said effective conveying path defined by said conveying means; and said length adjusting means being arranged in said transition region and being reciprocatingly displaceable relative to said predetermined conveying direction defined by said conveying means.

8. The apparatus as defined in claim 7, further including:

stop means arranged in said transition region defining the transition from said effective infeed path defined by said infeed means to said effective conveying path defined by said conveying means;

said stop means being arranged substantially above said conveying means; and said stop means acting upon the printed products infed by said infeed means and pushed onto said buffer stack.

9. The apparatus as defined in claim 8, wherein:

said length adjusting means contain slide means;

said stop means being arranged on said slide means;

said slide means being reciprocatingly displaceable relative to said predetermined conveying direction defined by said conveying means; and drive means for reciprocatingly displacing said slide means.

10. The apparatus as defined in claim 9, wherein:

said drive means contain a drive element;

said drive element being displaceable in said predetermined conveying direction defined by said conveying means at a speed substantially equal to said predetermined conveying speed defined by said conveying means;

said drive element being coupled to said slide means; and said drive means serving for displacing said slide means along said drive element in a direction opposite to said predetermined conveying direction defined by said conveying means.

11. The apparatus as defined in claim 10, wherein said drive means contain a motor and a wheel; and said motor driving said wheel such that said wheel rolls along said drive element.

12. The apparatus as defined in claim 11, wherein:

said drive element comprises a drive chain; and said wheel comprises a sprocket wheel operatively associated with said drive chain.

13. The apparatus as defined in claim 10, wherein said slide means contain a sensing device for determining the arrival of said printed products infed by said infeed means and for regulating said drive means for displacing said slide means.

14. The apparatus as defined in claim 13, wherein:

said buffer stack defines an end region; and said sensing device possessing a sensing element bearing upon said end region of said buffer stack.

15. The apparatus as defined in claim 9, wherein:

said infeed means contain at least one endless, circulatingly driven conveying element possessing an upper run;

said conveying means containing at least one conveying element possessing an upper run;

said upper run of said conveying element of said infeed means extending in front of said slide means, as seen in said predetermined conveyong direction defined by said conveying means, and above said conveying means;

deflection rolls mounted at said slide means;

said deflection rolls guiding said upper run of said conveying element of said infeed means; and said upper run of said conveying element of said infeed means extending, at the rear side of said side means, below said upper run of said conveying element of said conveying means.

16. The apparatus as defined in claim 8, wherein:

said buffer stack defines an end;

said stop means containing at least one roll supported at said end of said buffer stack;

a further roll preceding said at least one roll;

said stop means containing a stop element; and said stop element being guided at said further roll.

17. The apparatus as defined in claim 16, wherein:

said stop element comprises a circulatingly driven stop element.

18. The apparatus as defined in claim 6, further including:

a support supporting said stack at said stack accommodating means in a reclining configuration; and said conveying means containing an ascending end section ascending towards said support.

19. The apparatus as defined in claim 6, wherein:

said stack formed by said infed printed products at said stack accommodating means, defines an end remote from said withdrawal location;

a sensing device arranged at said end of said stack remote from said withdrawal location; and said sensing device being responsive to the size of said stack for regulating said predetermined conveying speed defined by said conveying means.

20. The loading apparatus as defined in claim 5, wherein:

said predetermined configuration of said buffer stack is a reclining configuration.

21. The loading apparatus as defined in claim 5, wherein:

said predetermined configuration of said buffer stack is an upright configuration.

22. A loading apparatus for loading a singling installation, especially a feeder, with printed products having lateral edges, said loading apparatus defining a predetermined general conveying direction in which the printed products are loaded into the singling installation, and said loading apparatus comprising:

infeed means for infeeding the printed products arriving in an imbricated formation with a predetermined mutual spacing between individual ones of the printed products of said imbricated formation;

stack accommodating means for accommodating a stack formed from the printed products infed by said infeed means such that the printed products in said stack formed at said stack accommodating means are substantially aligned at the lateral edges thereof;

a withdrawal location for removing said individual ones of the infed printed products from said stack accommodated by said stack accommodating means;

said withdrawal location bounding said stack accommodating means;

buffer stack forming means arranged intermediate said infeed means and said stack accommodating means for forming from said infed printed products a buffer stack of the infed printed products;

said buffer stack containing the infed printed products at an inclination relative to said predetermined general conveying direction of the loading apparatus and at a mutual spacing which is less than said predetermined mutual spacing between said individual ones of the printed products in said imbricated formation;

said buffer stack assuming a predetermined configuration and possessing an adjustable length;

said infeed means serving for infeeding the printed products in a predetermined infeed direction and at a predetermined infeed rate;

said buffer stack forming means containing conveying means defining a predetermined conveying direction corresponding to said predetermined general conveying direction of the loading apparatus and further defining a predetermined conveying speed;

said predetermined conveying direction defined by said conveying means having essentially the same direction as said predetermined infeed direction in which the printed products are infed by said infeed means;

said predetermined conveying speed of said conveying means being lower than said infeed rate at which the printed products are infed by said infeed means;

said infeed means defining an effective infeed path;

said conveying means defining an effective conveying path;

a transition region defining a transition from said effective infeed path defined by said infeed means to said effective conveying path defined by said conveying means;

said transiton region being displaceable in said predetermined conveying direction defined by said conveying means;

stop means arranged in said transition region defining the transition from said effective infeed path defined by said infeed means to said effective conveying path defined by said conveying means;

said stop means being arranged substantially above said conveying means; and said stop means acting upon the printed products infed by said infeed means and pushed onto said buffer stack.

23. The apparatus as defined in claim 22, wherein:

said buffer stack forming means contain slide means;

said stop means being arranged on said slide means;

said slide means being reciprocatingly displaceable in said predetermined conveying direction defined by said conveying means; and drive means for reciprocatingly displacing said slide means.

24. The apparatus as defined in claim 23, wherein:

said drive means contain a drive element;

said drive element being displaceable in said predetermined conveying direction defined by said conveying means at a speed substantially equal to said predetermined conveying speed defined by said conveying means;

said drive element being coupled to said slide means; and said drive means serving for displacing said slide means along said drive element in a direction opposite to said predetermined conveying direction defined by said conveying means.

25. The apparatus as defined in claim 24, wherein:

said drive means contain a motor and a wheel; and said motor driving said wheel such that said wheel rolls along said drive element.

26. The apparatus as defined in claim 25, wherein:

said drive element comprises a drive chain; and said wheel comprises a sprocket wheel operatively associated with said drive chain.

27. The apparatus as defined in claim 24, wherein:

said slide means contain a sensing device for determining the arrival of said printed products infed by said infeed means and for regulating said drive means for displacing said slide means.

28. The apparatus as defined in claim 27, wherein:

said buffer stack defines an end region; and said sensing device possessing a sensing element bearing upon said end region of said buffer stack.

29. The apparatus as defined in claim 23, wherein:

said infeed means contain at least one endless, circulatingly driven conveying element possessing an upper run;

said conveying means containing at least one conveying element possessing an upper run;

said upper run of said conveying element of said infeed means extending in front of said slide means, as seen in said predetermined conveying direction defined by said conveying means, and above said conveying means;

deflection rolls mounted at said slide means;

said deflection rolls guiding said upper run of said conveying element of said infeed means; and said upper run of said conveying element of said infeed means extending, at the rear side of said slide means, below said upper run of said conveying element of said conveying means.

30. The apparatus as defined in claim 22, wherein:

said buffer stack defines an end;

said stop means containing at least one roll supported at said end of said buffer stack;

a further roll preceding said at least one roll;

said stop means containing a stop element; and said stop element being guided at said further roll.

31. The apparatus as defined in claim 30, wherein:

said stop element comprises a circulatingly driven stop element.

32. A loading apparatus for loading a singling installation, especially a feeder, with printed products having lateral edges, said loading apparatus defining a predetermined general conveying direction in which the printed products are loaded into the singling installation, and said loading apparatus comprising:

infeed means for infeeding the printed products arriving in an imbricated formation with a predetermined mutual spacing between individual ones of the printed products of said imbricated formation;

stack accommodating means for accommodating a stack formed from the printed products infed by said infeed means such that the printed products in said stack formed at said stack accommodating means are substantially aligned at the lateral edges thereof;

a withdrawal location for removing said individual ones of the infed printed products from said stack accommodated by said stack accommodating means;

said withdrawal location bounding said stack accommodating means;

buffer stack forming means arranged intermediate said infeed means and said stack accommodating means for forming from said infed printed products a buffer stack of the infed printed products;

said buffer stack containing the infed printed products at an inclination relative to said predetermined general conveying direction of the loading apparatus and at a mutual spacing which is less than said predetermined mutual spacing between said individual ones of the printed products in said imbricated formation;

said buffer stack assuming a predetermined configuration and possessing an adjustable length;

said infeed means serving for infeeding the printed products in a predetermined infeed direction and at a predetermined infeed rate;

said buffer stack forming means containing conveying means defining a predetermined conveying direction corresponding to said predetermined general conveying direction of the loading apparatus and further defining a predetermined conveying speed;

said predetermined conveying direction defined by said conveying means having essentially the same direction as said predetermined infeed direction in which the printed products are infed by said infeed means;

said predetermined conveying speed of said conveying means being lower than said infeed rate at which the printed products are infed by said infeed means;

said stack formed by said infed printed products at said stack accommoating means, defining an end remote from said withdrawal location;

a sensing device arranged at said end of said stack remote from said withdrawal location; and said sensing device being responsive to the size of said stack for regulating said predetermined conveying speed defined by said conveying means.

* * * * *

UNITED STATES PATENT AND TRADEMARK OFFICE

CERTIFICATE OF CORRECTION

PATENT NO. : 4,718,656

DATED : January 12, 1988

INVENTOR(S) : WALTER REIST

It is certified that error appears in the above-identified patent and that said Letters Patent is hereby corrected as shown below:

Column 4, line 24, after "means" (second occurrence) please delete "13" and insert --13'--

Column 4, line 29, after "location" please insert --8--

Column 12, line 28, after "predetermined" please delete "conveyong" and insert --conveying--

Column 16, line 27, after "stack" please delete "accommoating" and insert --accommodating--

Signed and Sealed this

Fourteenth Day of June, 1988

*Attest:*

DONALD J. QUIGG

*Attesting Officer*

*Commissioner of Patents and Trademarks*